US010395807B2

(12) United States Patent
Terashima et al.

(10) Patent No.: US 10,395,807 B2
(45) Date of Patent: Aug. 27, 2019

(54) GRAIN-ORIENTED ELECTRICAL STEEL SHEET HAVING EXCELLENT MAGNETIC CHARACTERISTICS AND COATING ADHESION

(71) Applicant: JFE STEEL CORPORATION, Tokyo (JP)

(72) Inventors: Takashi Terashima, Kurashiki (JP); Makoto Watanabe, Okayama (JP); Masanori Uesaka, Kurashiki (JP); Ryuichi Suehiro, Kurashiki (JP); Toshito Takamiya, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 241 days.

(21) Appl. No.: 15/028,841

(22) PCT Filed: Oct. 23, 2014

(86) PCT No.: PCT/JP2014/078233

§ 371 (c)(1),
(2) Date: Apr. 12, 2016

(87) PCT Pub. No.: WO2015/064472

PCT Pub. Date: May 7, 2015

(65) Prior Publication Data

US 2016/0260531 A1 Sep. 8, 2016

(30) Foreign Application Priority Data

Oct. 30, 2013 (JP) ..... 2013-225122

(51) Int. Cl.

| | |
|---|---|
| ***H01F 1/147*** | (2006.01) |
| ***C21D 8/12*** | (2006.01) |
| ***C21D 9/46*** | (2006.01) |
| ***C22C 38/00*** | (2006.01) |
| ***C22C 38/60*** | (2006.01) |
| ***H01F 1/18*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/16*** | (2006.01) |
| ***C23C 22/33*** | (2006.01) |
| ***C23C 22/74*** | (2006.01) |

(52) U.S. Cl.

CPC ..... *H01F 1/14783* (2013.01); *C21D 8/0205* (2013.01); *C21D 8/0236* (2013.01); *C21D 8/0273* (2013.01); *C21D 8/0289* (2013.01); *C21D 8/12* (2013.01); *C21D 8/1233* (2013.01); *C21D 8/1244* (2013.01); *C21D 8/1272* (2013.01); *C21D 8/1283* (2013.01); *C21D 8/1288* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/16* (2013.01); *C22C 38/60* (2013.01); *C23C 22/33* (2013.01); *C23C 22/74* (2013.01); *H01F 1/18* (2013.01); *C21D 2201/05* (2013.01)

(58) Field of Classification Search
None
See application file for complete search history.

(56) References Cited

U.S. PATENT DOCUMENTS

| | | | | |
|---|---|---|---|---|
| 3,856,568 | A | 12/1974 | Tanaka et al. | |
| 4,213,792 | A | 7/1980 | Marianeschi et al. | |
| 4,238,534 | A * | 12/1980 | Ichida | H01F 1/14783 427/376.5 |
| 5,833,768 | A | 11/1998 | Kosuge et al. | |
| 2008/0190520 | A1 | 8/2008 | Watanabe et al. | |
| 2009/0032142 | A1 | 2/2009 | Kumano et al. | |
| 2009/0044881 | A1 | 2/2009 | Kumano et al. | |
| 2009/0233114 | A1 | 9/2009 | Takeda et al. | |
| 2014/0377573 | A1 | 12/2014 | Okubo et al. | |

FOREIGN PATENT DOCUMENTS

| | | | |
|---|---|---|---|
| CN | 101031667 | A | 9/2007 |
| DE | 28 10 155 | A1 | 9/1978 |
| DE | 22 47 269 | C3 | 5/1981 |
| EP | 1 227 163 | A2 | 7/2002 |
| EP | 2602346 | A1 | 6/2013 |
| EP | 2 743 358 | A1 | 6/2014 |
| EP | 2 025 766 | B1 | 8/2016 |
| JP | S48-39338 | A | 6/1973 |
| JP | S50-79442 | A | 6/1975 |
| JP | H05-132941 | A | 5/1993 |
| JP | H06-212262 | A | 8/1994 |
| JP | H07-62436 | A | 3/1995 |
| JP | H08-67913 | A | 3/1996 |
| JP | H10-298653 | A | 11/1998 |

(Continued)

OTHER PUBLICATIONS

Aug. 2, 2016 Search Report issued in European Patent Application No. 14857559.0.

(Continued)

*Primary Examiner* — Robert T Butcher
(74) *Attorney, Agent, or Firm* — Oliff PLC

(57) ABSTRACT

There is provided a grain-oriented electrical steel sheet stably having excellent magnetic characteristics and coating adhesion even when a rapid heating is conducted in a primary recrystallization annealing (decarburization annealing). Concretely, it is a grain-oriented electrical steel sheet provided on its sheet surface with a tension-applying type insulation coating constituted with a coating layer A formed on a steel sheet side and mainly composed of an oxide and a coating layer B formed on a surface side and mainly composed of glass, characterized in that a ratio R ($\sigma_B/\sigma_A$) of a tension $\sigma_B$ of the coating layer B on the surface side applied to the steel sheet to a tension $\sigma_A$ of the coating layer on the steel sheet side A applied to the steel sheet is within a range of 1.20-4.0.

18 Claims, No Drawings

(56) References Cited

FOREIGN PATENT DOCUMENTS

| | | | |
|---|---|---|---|
| JP | 2000-204450 | A | 7/2000 |
| JP | 2002-060957 | A | 2/2002 |
| JP | 2003-027194 | A | 1/2003 |
| JP | 2003-293103 | A | 10/2003 |
| JP | 2006-137972 | A | 6/2006 |
| JP | 2010-249616 | A | 11/2010 |
| RU | 2363739 | C1 | 8/2009 |
| RU | 2378393 | C1 | 1/2010 |
| RU | 2407818 | C2 | 12/2010 |
| WO | 2013/024772 | A1 | 2/2013 |
| WO | 2013/099455 | A1 | 7/2013 |

OTHER PUBLICATIONS

Jul. 5, 2017 Office Action issued in Russian Patent Application No. 2016121005.
Feb. 3, 2015 Search Report issued in International Patent Application No. PCT/JP2014/078233.
Jul. 26, 2017 Office Action issued in Chinese Patent Application No. 201480054725.7.
Dec. 5, 2016 Office Action issued in Chinese Patent Application No. 201480054725.7.
Jun. 8, 2016 Office Action issued in Japanese Patent Application No. 2013-225122.
Nov. 27, 2018 Notice of Opposition issued in European Patent Application No. 14857559.0.
Nov. 20, 2018 Declaration of Dr. Ludger Lahn with annexes 1, 2, 3, 4 and 5.
Oct. 11, 2018 Test Report of revierlabor GmbH, order No. 18-02178.
Data sheet 401: "Elektroband und -blech", ISSN 0175-2006, published by Stahl-Informations-Zentrum, 2005.

* cited by examiner

GRAIN-ORIENTED ELECTRICAL STEEL SHEET HAVING EXCELLENT MAGNETIC CHARACTERISTICS AND COATING ADHESION

TECHNICAL FIELD

This invention relates to a grain-oriented electrical steel sheet having excellent magnetic characteristics and coating adhesion.

RELATED ART

Grain-oriented electrical steel sheets are soft magnetic materials widely used as core materials for electric transformers, power generators and the like and are characterized by having a crystal structure wherein <001> orientation as an easy axis of magnetization is highly accumulated in the rolling direction of the steel sheet. Such a texture is formed through a secondary recrystallization annealing wherein crystal grains of {110}<001> orientation called as Goss orientation are preferentially and enormously grown at final annealing step in a production process of the grain-oriented electrical steel sheet.

On the surface of the grain-oriented electrical steel sheet are generally formed two coating layers, i.e. a coating layer mainly composed of an oxide such as forsterite or the like and a coating layer mainly composed of phosphate-system glass from the steel sheet side. The phosphate-system glassy coating is formed for the purpose of providing insulation properties, workability and corrosion resistance. However, since an adhesion between glass and metal is low, a ceramic layer mainly composed of an oxide such as forsterite and the like is interposed therebetween to increase the coating adhesion. These coatings are formed at a high temperature and have a low coefficient of thermal expansion as compared to the steel sheet, so that a tension (tensile stress) is applied to the steel sheet through a difference in the coefficient of thermal expansion between the steel sheet and the coating caused when the temperature thereof is decreased to a room temperature, whereby an effect of decreasing an iron loss is caused. Incidentally, Patent Document 1 discloses that it is desirable to apply a high tension of not less than 8 MPa to the steel sheet in order to obtain the above effect of decreasing the iron loss.

Various glassy coatings have heretofore been proposed for applying the high tension to the steel sheet as mentioned above. For example, Patent Document 2 proposes a coating mainly composed of magnesium phosphate, colloidal silica and chromic anhydride, and Patent Document 3 proposes a coating mainly composed of aluminum phosphate, colloidal silica and chromic anhydride.

As a technique for improving the coating adhesion, for example, Patent Document 4 discloses a technique wherein the coating adhesion is increased by making the tension of the coating applied to the steel sheet to not more than 8 MPa and properly adjusting a coating weight ratio between a forsterite layer and an inorganic insulation coating for the specialized purpose to direct ignition.

On the other hand, reduction of the sheet thickness, increase of Si content, improvement of the crystal orientation, application of tension to the steel sheet, smoothing of the steel sheet surface, refining of the secondary recrystallized grains and the like are known to be effective from a viewpoint of increasing the magnetic characteristics, particularly decreasing the iron loss. In recent years, as a technique of refining secondary recrystallized grains are particularly developed a method of rapidly heating in a primary recrystallization annealing or in a primary recrystallization annealing combined with a decarburization annealing, a method of conducting a rapid heating treatment just before a primary recrystallization annealing to improve primary recrystallized texture, and so on.

For example, Patent Document 5 discloses a technique wherein a steel strip rolled to a final thickness is rapidly heated to a temperature of 800-950° C. at a heating rate of not less than 100° C./s in an atmosphere having an oxygen concentration of not more than 500 ppm before a decarburization annealing and then subjected to the decarburization annealing at a temperature lower than the reaching temperature by the rapid heating, or 775-840° C. in a first half area of the decarburization annealing and at a temperature higher than that of the first half area, or 815-875° C. in a subsequent second half area to thereby obtain a grain-oriented electrical steel sheet having low iron loss. Also, Patent Document 6 discloses a technique wherein a steel strip rolled to a final thickness is rapidly heated to a temperature of not lower than 700° C. at a heating rate of not less than 100° C./s in a non-oxidizing atmosphere with $pH_2O/pH_2$ of not more than 0.2 just before a decarburization annealing to thereby obtain a grain-oriented steel sheet having low iron loss.

Further, Patent Document 7 discloses a technique wherein a temperature zone of at least not lower than 600° C. in a heating stage of a decarburization annealing process is heated to not lower than 800° C. at a heating rate of not less than 95° C./s and an atmosphere of this temperature zone is constituted with an inert gas containing oxygen of $10^{-6}$-$10^{-1}$ as a volume fraction, and a constituent of an atmosphere at the time of soaking in the decarburization annealing is $H_2$ and $H_2O$ or $H_2$, $H_2O$, and an inert gas and a ratio $pH_2O/pH_2$ of a $H_2O$ partial pressure to a $H_2$ partial pressure is set to 0.05-0.75, and a flow rate of the atmospheric gas per unit area is set to 0.01-1 $Nm^3/min \cdot m^2$, whereby a ratio of crystal grains in a mixture region of the coatings and steel sheet having a deviation angle of not more than 10 degree from Goss orientation of the steel sheet crystal grains is set to not more than 50% to thereby obtain a grain-oriented steel sheet having excellent coating properties and magnetic characteristics. Patent Document 8 discloses a technique wherein a temperature zone of at least not lower than 650° C. in a heating stage of a decarburization annealing process is heated to not lower than 800° C. at a heating rate of not less than 100° C./s, and an atmosphere of this temperature zone is constituted with an inert gas containing oxygen of $10^{-6}$-$10^{-2}$ as a volume fraction, and a constituent of an atmosphere at the time of soaking in the decarburization annealing is $H_2$ and $H_2O$ or $H_2$, $H_2O$, and an inert gas and a ratio $pH_2O/pH_2$ of a $H_2O$ partial pressure to a $H_2$ partial pressure is set to 0.15-0.65 to thereby obtain a grain-oriented steel sheet having excellent coating properties and magnetic characteristics.

PRIOR ART DOCUMENTS

Patent Documents

Patent Document 1: JP-A-H08-67913
Patent Document 2: JP-B-S56-52117 (JP-A-S50-79442)
Patent Document 3: JP-B-S53-28375 (JP-A-S48-39338)
Patent Document 4: JP-A-2002-60957
Patent Document 5: JP-A-H10-298653
Patent Document 6: JP-A-H07-62436
Patent Document 7: JP-A-2003-27194

Patent Document 8: Japanese Patent No. 3537339 (JP-A-2000-204450)

SUMMARY OF THE INVENTION

Task to be Solved by the Invention

It has been attempted to improve the magnetic characteristics and coating properties through refinement of the secondary recrystallized grains by the techniques disclosed in the Patent Documents, particularly properly adjusting the heating conditions in the primary recrystallization annealing (decarburization annealing). However, even if any combination of the above techniques is used, there are found some cases that the coating properties, particularly coating adhesion are poor.

The invention is made in view of the aforementioned problems inherent to the conventional techniques and is to provide a grain-oriented electrical steel sheet having stably excellent magnetic characteristics and coating adhesion even if a rapid heating is conducted in a primary recrystallization annealing (decarburization annealing).

Solution for Task

The inventors have focused on the fact that a coating on the surface of the grain-oriented electrical steel sheet is constituted with two coating layers, i.e. a coating layer formed on the steel sheet side and mainly composed of an oxide and a coating layer formed on the surface side and mainly composed of glass, and made various studies on a measure of improving the coating adhesion for solving the above task. As a result, it has been found that not only the magnetic characteristics but also the adhesion between the coating layer on the steel sheet side and the steel sheet can be largely improved by properly adjusting a ratio between a tension of the coating layer formed on the steel sheet side and mainly composed of an oxide and applied to the steel sheet and a tension of the coating layer formed on the surface side and mainly composed of glass and applied to the steel sheet, and the invention has been accomplished.

That is, the invention lies in a grain-oriented electrical steel sheet provided on its sheet surface with a tension-imparting type insulation coating constituted with a coating layer A formed on a steel sheet side and mainly composed of an oxide and a coating layer B formed on the surface side and mainly composed of glass, characterized in that a ratio R ($\sigma_B/\sigma_A$) of a tension $\sigma_B$ of the coating layer B on the surface side applied to the steel sheet to a tension $\sigma_A$ of the coating layer on the steel sheet side A applied to the steel sheet is within a range of 1.20-4.0.

The grain-oriented electrical steel sheet according to the invention is characterized in that the oxide of the coating layer A on the steel sheet side is forsterite and the glass of the coating layer B on the surface side is silicophosphate based glass containing one or more metallic elements selected from Mg, Al, Ca, Ti, Nd, Mo, Cr, B, Ta, Cu and Mn.

Also, the grain-oriented electrical steel sheet according to the invention is characterized in that the tension $\sigma_A$ of the coating layer A on the steel sheet side applied to the steel sheet is not more than 6 MPa.

Furthermore, the grain-oriented electrical steel sheet according to the invention is characterized in that a coating weight of the coating layer A on the steel sheet side is 1.0-3.0 g/m$^2$ (both sides) as converted to oxygen.

The grain-oriented electrical steel sheet according to the invention is characterized in that it is formed by subjecting a cold rolled sheet rolled to a final thickness to a secondary recrystallization annealing after a primary recrystallization annealing of heating at a heating rate of not less than 50° C./s from 100° C. to 700° C.

Effect of the Invention

According to the invention, it is made possible to stably produce a grain-oriented electrical steel sheet having excellent magnetic characteristics and coating adhesion only by adjusting a tension ratio applied to the steel sheet between a coating layer on the steel sheet side mainly composed of an oxide and a coating layer on the surface side mainly composed of glass to a proper range without requiring a precise control for forming the coating layer in a primary recrystallization annealing, a primary recrystallization annealing combined with a decarburization annealing or a secondary recrystallization annealing. Moreover, according to the invention, it is possible to establish both the coating adhesion and magnetic characteristics even in steel sheets not subjected to rapid heating in a primary recrystallization annealing or a primary recrystallization annealing combined with a decarburization annealing, so that industrial effects are very large.

EMBODIMENTS FOR CARRYING OUT THE INVENTION

As previously mentioned, it is attempted in the conventional art to establish both improvements of the magnetic characteristics and the coating properties through the refinement of the secondary recrystallized grains by properly adjusting the heating conditions in the primary recrystallization annealing or the primary recrystallization annealing combined with decarburization annealing (hereinafter simply referred to as primary recrystallized annealing), but it is actual that stable effects on the coating adhesion are not necessarily obtained. The inventors have made many experiments and studied on the cause, and hence considered as follows.

The method of conducting rapid heating in the primary recrystallization annealing to refine the secondary recrystallized grains is a very excellent technique for improving the magnetic characteristics, but exerts a great influence on an initial oxidation state of the steel sheet surface, and particularly decreases a density of an inner oxide layer formed through the decarburization annealing, which has an adverse impact on a density of a ceramic coating formed in the secondary recrystallization annealing and hence on the coating adhesion to the steel sheet and causes deterioration of the coating properties.

Therefore, the inventors have focused on the fact that the coating on the surface of the grain-oriented electrical steel sheet is constituted with two coating layers, i.e. a coating layer formed on the steel sheet side and mainly composed of an oxide and an coating layer formed on the surface side and mainly composed of glass, and further investigated on the measure for improving the coating adhesion. As a result, it has been found that not only the magnetic characteristics but also the coating adhesion between the coating layer on the steel sheet side and the steel sheet can be largely improved by adjusting a ratio R ($=\sigma_B/\sigma_A$) between a tension $\sigma_A$ of a coating layer formed on the steel sheet side and mainly composed of an oxide (hereinafter referred to as "coating layer on the steel sheet side" or "coating layer A") applied to the steel sheet and a tension $\sigma_B$ of a coating layer formed on the surface side and mainly composed of glass (hereinafter referred to as "coating layer on the surface side" or "coating layer B") applied to the steel sheet (hereinafter referred to as "tension ratio" simply) to a proper range.

That is, the grain-oriented electrical steel sheet according to the invention is a grain-oriented electrical steel sheet provided on its sheet surface with a tension-imparting type insulation coating constituted with two layers of a coating layer A formed on the steel sheet side and mainly composed of an oxide and a coating layer B formed on the surface side and mainly composed of glass, and requires that a ratio (tension ratio) R ($\sigma_B/\sigma_A$) of a tension $\sigma_B$ of the coating layer B on the surface side applied to the steel sheet to a tension $\sigma_A$ of the coating layer A on the steel sheet side applied to the steel sheet is within a range of 1.20-4.0.

When the tension ratio R is less than 1.20, the effect of decreasing the iron loss in the coating layer on the surface side applying a higher tension to the steel sheet than the coating layer on the steel sheet side is not obtained sufficiently. While, when the tension ratio R exceeds 4.0, the tension of the coating layer on the steel sheet side received from the coating layer on the surface side becomes excessive, which has an adverse influence on the adhesion strength of an interface between the steel sheet and the coating layer on the steel sheet side to decrease the coating adhesion. The tension ratio R is preferably within a range of 1.4-3.0.

Moreover, the tension of the coating layer on the steel sheet surface applied to the steel sheet is a tension in the rolling direction, the size of which can be calculated with the following formula from a warp size of the steel sheet when a coating layer on one side surface of the steel sheet is removed with an alkali, acid or the like:

Tension applied to the steel sheet (MPa)=(Young's modulus of the steel sheet (GPa))×steel thickness (mm)×warp size (mm)÷(length of the test specimen for warp measurement (mm))$^2$×10$^3$ (wherein 132 GPa is used as the Young's modulus of the steel sheet).

Moreover, when the coating layer is constituted with two layers, the tension of the each layer is measured in a manner that only an outermost layer (layer B) is firstly removed to measure a warp, from which the tension of the layer B is calculated, and subsequently an inner layer (layer A) is removed to measure a warp, from which the tension of (layer A+layer B) is calculated, and a difference of the tension between the layer B and (layer A+layer B) is regarded as the tension of the inner layer (layer A).

The coating layer on the steel sheet side mainly composed of an oxide in the grain-oriented electrical steel sheet according to the invention is preferably a ceramic layer such as forsterite, cordierite or the like, and among them, forsterite is more preferable. When the coating layer is an oxide coating mainly composed of forsterite, it can be produced at a low cost by applying an annealing separator mainly composed of MgO after decarburization annealing and then conducting final annealing.

Meanwhile, the coating layer on the surface side mainly composed of glass is preferably made of a silicophosphate based glass. When the coating layer is the silicophosphate based glass, a high tensile force can be applied to the steel sheet even in a low-temperature baking of not higher than 1000° C. Moreover, it is preferable that the silicophosphate based glass contains one or more metallic elements selected from Mg, Al, Ca, Ti, Nd, Mo, Cr, B, Ta, Cu and Mn for the purpose of increasing the chemical durability to water as a defect.

In the grain-oriented electrical steel sheet according to the invention, it is preferable that tension $\sigma_A$ of the coating layer on the steel sheet side applied to the steel sheet is not more than 6 MPa. When it is not more than 6 MPa, stress between the steel sheet and the coating layer on the steel sheet side is relatively small, so that a critical stress value causing stripping becomes high even in a bend and stripping test and hence the coating adhesion is increased. However, in order to obtain an effect of decreasing the iron loss, the tension $\sigma_A$ is preferable to be not less than 1.0 MPa. More preferably, it is within a range of 1.5-4.0 MPa.

In the grain-oriented electrical steel sheet according to the invention, a coating weight of the coating layer on the steel sheet side (the layer mainly composed of an oxide) is preferably within a range of 1.0-3.0 g/m$^2$ as converted to oxygen. When it is not less than 1.0 g/m$^2$, a coating ratio of the steel sheet with the coating layer becomes sufficiently high, and the uniformity in the appearance of the coating layer becomes excellent even if the coating layer on the surface side mainly composed of glass is formed. While, when it is not more than 3.0 g/m$^2$, the thickness of the coating layer on the steel sheet side becomes thin and hence the coating adhesion is excellent. More preferably, it is within a range of 1.5-3.0 g/m$^2$.

Moreover, the grain-oriented electrical steel sheet intended in the invention is produced by an ordinary well-known method and can be used as long as two layers consisting of a coating layer mainly composed of an oxide and another coating layer on the surface side mainly composed of glass are included on the surface of the steel sheet, but the steel sheet is preferable to be produced by a method explained below.

First, a steel raw material (slab) as a raw material of the grain-oriented electrical steel sheet according to the invention is preferable to have the following chemical composition.

C: 0.001-0.10 mass %

C is an element effective for generating Goss orientation grains, and is preferable to be contained in an amount of not less than 0.001 mass % in order to exhibit such an effect efficiently. However, when it exceeds 0.10 mass %, it becomes difficult to decarburize to a level causing no magnetic aging (not more than 0.005 mass %) in the subsequent decarburization annealing. Therefore, C is preferable to be within a range of 0.001-0.10 mass %. More preferably, it is within a range of 0.010-0.08 mass %, Si: 1.0-5.0 mass %

Si is an element necessary for not only increasing an electrical resistance of steel to decrease the iron loss but also stabilizing BCC structure of iron to enable heat treatment at a high temperature, and is preferable to be added in an amount of at least 1.0 mass %. However, the addition exceeding 5.0 mass % makes it difficult to perform cold rolling. Therefore, Si is preferable to be within a range of 1.0-5.0 mass %. More preferably, it is within a range of 2.0-4.5 mass %.

Mn: 0.01-1.0 mass %

Mn not only contributes effectively to improve hot brittleness of steel, but also forms precipitates such as MnS, MnSe and the like when S and Se are contained to exhibit function as an inhibitor. When Mn content is less than 0.01 mass %, the above effect becomes insufficient, while when it exceeds 1.0 mass %, the grain size of the precipitates such as MnSe or the like is coarsened to lose the effect as the inhibitor. Therefore, Mn is preferable to be within a range of 0.01-1.0 mass %. More preferably, it is within a range of 0.015-0.80 mass %.

sol. Al: 0.003-0.050 mass %

Al is an element useful for forming AlN in steel as a secondary dispersion phase and working as an inhibitor. When the addition amount is less than 0.003 mass %, the precipitation amount of AlN cannot be sufficiently ensured, while when it is added in an amount exceeding 0.050 mass %, AlN is precipitated in a coarsened state to lose the effect as the inhibitor. Therefore, Al is preferably within a range of 0.003-0.050 mass % as sol. Al. More preferably, it is within a range of 0.005-0.045 mass %.

N: 0.001-0.020 mass %

N is an element necessary for forming AlN like Al. When the addition amount is less than 0.001 mass %, the precipitation of AlN becomes insufficient, while when it is added in an amount exceeding 0.020 mass %, blistering or the like is caused in the reheating of the slab to cause surface defects. Therefore, N is within a range of 0.001-0.020 mass %. More preferably, it is within a range of 0.002-0.015 mass %.

One or two selected from S and Se: 0.001-0.05 mass % in total

S and Se are elements useful for bonding to Mn and Cu to form MnSe, MnS, $Cu_{2-x}Se$ and $Cu_{2-x}S$ as a secondary dispersion phase in steel and exhibiting a function as an inhibitor. When the total content of S and Se is less than 0.001 mass %, the above effect is poor, while when it exceeds 0.05 mass %, not only solid solution in the reheating of the slab becomes insufficient, but also the surface defects of the product sheet are caused. Therefore, in each case of an independent addition and a combined addition, the addition amount is preferably within a range of 0.01-0.05 mass % in total. More preferably, it is within a range of 0.015-0.045 mass %.

The steel raw material used for the grain-oriented electrical steel sheet according to the invention may contain one or more selected from Cu: 0.01-0.2 mass %, Ni: 0.01-0.5 mass %, Cr: 0.01-0.5 mass %, Sb: 0.01-0.1 mass %, Sn: 0.01-0.5 mass %, Mo: 0.01-0.5 mass % and Bi: 0.001-0.1 mass % in addition to the above chemical compositions. These elements are liable to be easily segregated into the crystal grains or on the surface thereof and have a function as an auxiliary inhibitor, so that it is made possible to further improve the magnetic characteristics when they are added. However, if any one of the elements is added in an amount of less than the each addition amount, the addition effect cannot be obtained. While, when it exceeds the addition amount, the poor appearance of the coating or the bad secondary recrystallization is easily caused, so that when they are added, the each addition amount is preferable to be within the above range.

Also, the steel raw material used for the grain-oriented electrical steel sheet according to the invention may contain one or more selected from B: 0.001-0.01 mass %, Ge: 0.001-0.1 mass %, As: 0.005-0.1 mass %, P: 0.005-0.1 mass %, Te: 0.005-0.1 mass %, Nb: 0.005-0.1 mass %, Ti: 0.005-0.1 mass % and V: 0.005-0.1 mass % in addition to the above chemical compositions. By the addition of these elements can be further reinforced the inhibiting force of the inhibitor to provide higher magnetic characteristics stably.

Next, the method of producing the grain-oriented electrical steel sheet according to the invention with a steel raw material having the above chemical composition will be explained.

The grain-oriented electrical steel sheet according to the invention can be produced by a production method comprising a series of steps of melting steel having the above-mentioned chemical composition by a conventional refining process to provide a steel raw material (slab) with a continuous casting process or an ingot casting and blooming method, hot rolling the slab to form a hot rolled sheet, performing or not performing a hot band annealing, subjecting the hot rolled sheet to a cold rolling or more cold rollings interposing intermediate annealings therebetween to provide a cold rolled sheet having a final thickness, subjecting the sheet to a primary recrystallization annealing or a primary recrystallization annealing combined with decarburization annealing, applying an annealing separator, for example, mainly composed of MgO to the surface of the steel sheet, drying, winding in a coil, subjecting to a final annealing to form a coating layer mainly composed of forsterite, further applying a vitreous insulation coating and the conducting a flattening annealing combined with baking and shape correction. As to the production conditions other than the primary recrystallization annealing (decarburization annealing) and the application of the annealing separator to the steel sheet surface before the final annealing, the conventionally well-known conditions can be adopted, so that they are not particularly limited.

In the primary recrystallization annealing or the primary recrystallization annealing combined with decarburization annealing, it is preferable to increase a heating rate in the heating process to not less than 50° C./s. By such a rapid heating can be increased a ratio of Goss orientation in the primary recrystallized texture to increase the number of Goss-oriented grains after the secondary recrystallization, whereby an average grain sizes can be made small to improve the iron loss property. However, when the heating rate becomes too high, the amount of {111} textures encroached by the Goss orientation {110}<001> is decreased and the poor secondary recrystallization is easily caused, so that the upper limit of the heating rate is preferable to be approximately 300° C./s. More preferably, it is within a range of 80-250° C./s.

The temperature range conducting the rapid heating in the primary recrystallization annealing is preferably within a range of 100-700° C. The temperature when the steel sheet reaches the annealing furnace is varied in accordance with ambient temperature, a treating temperature in the precedent process, a carrying time of the steel sheet and the like, so that the temperature of not lower than 100° C. makes the control easy. On the other hand, if the temperature ending the rapid heating exceeds 700° C. starting the primary recrystallization, not only the effect of the rapid heating is saturated, but also the energy cost required for the rapid heating is increased, which is not preferable.

When the decarburization annealing is performed in the primary recrystallization annealing, it is preferable to render C in steel into less than 0.0050 mass % during the annealing. To this end, when C content in the steel raw material (slab) is less than 0.0050 mass %, it is not necessarily conducted. Also, the decarburization annealing may not be combined with the primary recrystallization annealing but may be conducted separately. When the decarburization annealing is conducted prior to the primary recrystallization annealing, it is required to conduct rapid heating in the decarburization annealing.

In order to form the coating layer mainly composed of an oxide such as forsterite, cordierite or the like, it is preferable to use an annealing separator mainly composed of MgO or containing MgO as the annealing separator applied onto the surface of the steel sheet after the primary recrystallization annealing and before the final annealing.

In the case of forming a mirror surface without forming forsterite in the final annealing, thereafter forming a coating mainly composed of an oxide by a method such as CVD (chemical vapor deposition), PVD (physical vapor deposition), sol-gel method, oxidation of the steel sheet or the like and then forming an insulation coating mainly composed of glass, an annealing separator mainly composed of $Al_2O_3$ may be used. In this case, however, a coating weight converted to oxygen on the surface of the steel sheet is preferable to be within a range of 1.0-3.0 g/m$^2$.

Example 1

A slab containing C: 0.06 mass %, Si: 3.3 mass %, Mn: 0.08 mass %, S: 0.001 mass %, Al: 0.015 mass %, N: 0.006 mass %, Cu: 0.05 mass % and Sb: 0.01 mass % is reheated at 1100° C. for 30 minutes, hot-rolled to obtain a hot rolled sheet having a thickness of 2.2 mm, which is subjected to a hot band annealing at 1000° C. for 1 minute and then cold rolled to obtain a cold rolled sheet having a final thickness of 0.23 mm. A test specimen having a width of 100 mm and a length of 400 mm is cut out from a center portion of a coil of the cold rolled sheet, heated from room temperature to 820° C. at a heating rate of 20° C./s and subjected to a primary recrystallization annealing combined with a decarburization annealing under a wet atmosphere in a laboratory. At that time, a time of the primary recrystallization annealing is changed variously as shown in Table 1 to vary a coating weight converted to oxygen on the surface of the steel sheet after the annealing.

of magnesium phosphate as $Mg(PO_3)_2$, 60 mol % of colloidal silica as $SiO_2$ and 10 mol % of $CrO_3$ is applied onto the surface of the test specimen and baked at 850° C. for 1 minute. At that time, the tension of the insulating tension coating applied to the steel sheet is varied by changing the coating weight of the coating liquid variously.

As to the test specimen thus obtained, tensions ($\sigma_A$, $\sigma_B$) of the forsterite coating (coating layer on the steel sheet side) and the glassy coating (coating layer on the surface side) applied to the steel sheet, magnetic flux density $B_8$ at a magnetizing force of 800 A/m and iron loss $W_{17/50}$ at 1.7 T and 50 Hz are measured, while a coating stripping test (bend and stripping test) after a stress-relief annealing at 800° C. for 3 hours in a nitrogen atmosphere is conducted, results of which are also shown in Table 1.

As seen from Table 1, when the tension ratio R is less than 1.20, the iron loss $W_{17/50}$ is deteriorated to 0.95 W/kg, while when it is not less than 4.0, the bend and stripping resistance is deteriorated to not less than 45 mm. Whereas, when R applicable to the invention example is in a range of 1.20-4.0, both the magnetic characteristics and the coating properties are good, and when the coating weight converted to oxygen of the forsterite coating is 1.0-3.0 g/m$^2$ and the tension of the

TABLE 1

| | | Coating properties | | | | Steel sheet characteristics | | | |
|---|---|---|---|---|---|---|---|---|---|
| No | Primary recrystallization annealing time (s) | Coating weight converted to oxygen (g/m$^2$) | Tensile force $\sigma_A$ of forsterite coating (MPa) | Tensile force $\sigma_B$ of glassy coating (MPa) | Tension ratio R (=$\sigma_B/\sigma_A$) | Magnetic flux density $B_8$ (T) | Iron loss $W_{17/50}$ (W/kg) | Bend and stripping diameter (mm) | Remarks |
| 1 | 45 | 1.5 | 1.8 | 4.0 | 2.2 | 1.90 | 0.89 | 20 | Invention Example |
| 2 | 60 | 1.8 | 2.2 | 4.0 | 1.9 | 1.91 | 0.89 | 20 | Invention Example |
| 3 | 90 | 2.0 | 2.4 | 4.0 | 1.7 | 1.92 | 0.89 | 20 | Invention Example |
| 4 | 120 | 2.5 | 3.0 | 4.0 | 1.3 | 1.92 | 0.90 | 20 | Invention Example |
| 5 | 180 | 3.0 | 3.6 | 4.0 | 1.1 | 1.91 | 0.95 | 20 | Comparative Example |
| 6 | 45 | 1.5 | 1.8 | 6.0 | 3.3 | 1.90 | 0.87 | 25 | Invention Example |
| 7 | 60 | 1.8 | 2.2 | 6.0 | 2.8 | 1.91 | 0.87 | 20 | Invention Example |
| 8 | 90 | 2.0 | 2.4 | 6.0 | 2.5 | 1.92 | 0.86 | 20 | Invention Example |
| 9 | 120 | 2.5 | 3.0 | 6.0 | 2.0 | 1.92 | 0.85 | 20 | Invention Example |
| 10 | 180 | 3.0 | 3.6 | 6.0 | 1.7 | 1.91 | 0.86 | 20 | Invention Example |
| 11 | 45 | 1.5 | 1.8 | 8.0 | 4.4 | 1.90 | 0.87 | 45 | Comparative Example |
| 12 | 60 | 1.8 | 2.2 | 8.0 | 3.7 | 1.91 | 0.87 | 25 | Invention Example |
| 13 | 90 | 2.0 | 2.4 | 8.0 | 3.3 | 1.92 | 0.86 | 25 | Invention Example |
| 14 | 120 | 2.5 | 3.0 | 8.0 | 2.7 | 1.92 | 0.86 | 20 | Invention Example |
| 15 | 180 | 3.0 | 3.6 | 8.0 | 2.2 | 1.91 | 0.86 | 20 | Invention Example |
| 16 | 90 | 2.0 | 2.4 | 10.0 | 4.2 | 1.92 | 0.88 | 50 | Comparative Example |
| 17 | 120 | 2.5 | 3.0 | 10.0 | 3.3 | 1.92 | 0.87 | 25 | Invention Example |
| 18 | 180 | 3.0 | 3.6 | 10.0 | 2.8 | 1.91 | 0.84 | 20 | Invention Example |
| 19 | 360 | 6.0 | 7.2 | 10.0 | 1.4 | 1.92 | 0.87 | 30 | Invention Example |
| 20 | 390 | 7.0 | 8.4 | 10.0 | 1.2 | 1.91 | 0.90 | 30 | Invention Example |
| 21 | 45 | 1.5 | 1.8 | 12.0 | 6.7 | 1.90 | 0.84 | 50 | Comparative Example |
| 22 | 120 | 2.5 | 3.0 | 12.0 | 4.0 | 1.92 | 0.82 | 20 | Invention Example |
| 23 | 180 | 3.0 | 3.6 | 12.0 | 3.3 | 1.91 | 0.82 | 25 | Invention Example |
| 24 | 360 | 6.0 | 7.2 | 12.0 | 1.7 | 1.92 | 0.82 | 30 | Invention Example |
| 25 | 450 | 8.0 | 9.6 | 12.0 | 1.3 | 1.91 | 0.90 | 35 | Invention Example |

Next, the test specimen is coated with an aqueous slurry of an annealing separator containing $TiO_2$ of 10 parts by mass added to MgO of 100 parts by mass, dried and subjected to a final annealing by heating from 300° C. to 800° C. spending 100 hours, heating to 1200° C. at a rate of 50° C./hr to complete secondary recrystallization and then holding 1200° C. for 5 hours for purification. Subsequently, a coating liquid of a silicophosphate based insulating tension coating having a chemical composition containing 30 mol % forsterite coating applied to the steel sheet is not more than 6 MPa, the bend and stripping resistance is much better as not more than 25 mm.

Example 2

From the same cold rolled sheet as used in Example 1 is cut out a test specimen having a width of 100 mm and a length of 400 mm, which is subjected to a primary recrystallization annealing combined with a decarburization annealing by heating from 100° C. to 700° C. at a heating rate shown in Table 2, further heating to 850° C. at 20° C./s and holding it for 120 seconds under a wet atmosphere in a laboratory. Then, an aqueous slurry of an annealing separator containing $Al_2O_3$ and MgO at a ratio of 3:2 by a mass ratio is applied onto the surface of the test specimen and dried. Thereafter, the test specimen is subjected to a final annealing by heating from 300° C. to 800° C. spending 100 hours, heating to 1250° C. at a rate of 50° C./hr to complete secondary recrystallization and then conducting purification at 1250° C. for 5 hours to form a coating composed of cordierite ($2MgO.2Al_2O_3.5SiO_2$) on the surface of the steel sheet. Here, a coating weight of the coating as converted to oxygen is 2.0 g/m$^2$ and a tension applied to the steel sheet is 4.0 MPa.

A silicophosphate based insulating tension coating containing 30 mol % of magnesium phosphate as $Mg(PO_3)_2$, 60 mol % of colloidal silica as $SiO_2$ and 10 mol % in total of various metallic elements listed in Table 2 as converted to oxygen is applied onto the surface of the test specimen and baked at 880° C. for 1 minute. At that time, a tension applied to the steel sheet is varied by variously changing a coating weight of the coating layer.

As to the test specimen thus obtained, tensions ($\sigma_A$, $\sigma_B$) of the forsterite coating (coating layer on the steel sheet side) and the glassy coating (coating layer on the surface side) applied to the steel sheet, magnetic flux density $B_8$ at a magnetizing force of 800 A/m and iron loss $W_{17/50}$ at 1.7 T and 50 Hz are measured, while coating stripping test (bend and stripping test) after a stress-relief annealing at 800° C.

TABLE 2

| | Heating rate in primary recrystallization annealing | Coating properties | | | | | | | | | | | |
|---|---|---|---|---|---|---|---|---|---|---|---|---|---|
| | | Metallic element content (as converted to oxygen; mol %) | | | | | | | | | | Tensile force $\sigma_B$ of glassy coating | Tension ratio R |
| | (° C./s) | $Al_2O_3$ | CaO | $TiO_2$ | $Nd_2O_3$ | $MoO_3$ | $CrO_3$ | $B_2O_3$ | $Ta_2O_5$ | CuO | MnO | (MPa) | (=$\sigma_B/\sigma_A$) |
| 1 | 20 | — | — | — | — | — | 10 | — | — | — | — | 12.0 | 3.0 |
| 2 | 30 | — | — | — | — | — | 10 | — | — | — | — | 12.0 | 3.0 |
| 3 | 40 | — | — | — | — | — | 10 | — | — | — | — | 12.0 | 3.0 |
| 4 | 50 | — | — | — | — | — | 10 | — | — | — | — | 12.0 | 3.0 |
| 5 | 100 | — | — | — | — | — | 10 | — | — | — | — | 12.0 | 3.0 |
| 6 | 150 | — | — | — | — | — | 10 | — | — | — | — | 12.0 | 3.0 |
| 7 | 200 | — | — | — | — | — | 10 | — | — | — | — | 12.0 | 3.0 |
| 8 | 250 | — | — | — | — | — | 10 | — | — | — | — | 12.0 | 3.0 |
| 9 | 150 | 10 | — | — | — | — | — | — | — | — | — | 12.0 | 3.0 |
| 10 | 150 | — | 10 | — | — | — | — | — | — | — | — | 12.0 | 3.0 |
| 11 | 150 | — | — | 10 | — | — | — | — | — | — | — | 12.0 | 3.0 |
| 12 | 150 | — | — | 5 | 5 | — | — | — | — | — | — | 12.0 | 3.0 |
| 13 | 150 | 5 | — | | — | 5 | — | — | — | — | — | 12.0 | 3.0 |
| 14 | 150 | — | — | — | — | — | — | 10 | — | — | — | 12.0 | 3.0 |
| 15 | 150 | — | — | — | — | — | — | — | 5 | 5 | — | 12.0 | 3.0 |
| 16 | 150 | — | — | — | — | — | — | — | — | 10 | — | 12.0 | 3.0 |
| 17 | 150 | — | — | — | — | — | — | — | — | — | 10 | 12.0 | 3.0 |
| 18 | 100 | 10 | — | — | — | — | — | — | — | — | — | 4.0 | 1.0 |
| 19 | 200 | — | — | — | — | — | 10 | — | — | — | — | 16.0 | 4.0 |
| 20 | 50 | — | — | 10 | — | — | — | — | — | — | — | 18.0 | 4.5 |
| 21 | 250 | — | — | 5 | 5 | — | — | — | — | — | — | 17.0 | 4.3 |

| | Steel sheet characteristics | | | |
|---|---|---|---|---|
| | Magnetic flux density $B_8$ (T) | Iron loss $W_{17/50}$ (W/kg) | Bend and stripping diameter (mm) | Remarks |
| 1 | 1.90 | 0.90 | 20 | Invention Example |
| 2 | 1.90 | 0.89 | 20 | Invention Example |
| 3 | 1.90 | 0.90 | 20 | Invention Example |
| 4 | 1.92 | 0.84 | 20 | Invention Example |
| 5 | 1.91 | 0.82 | 20 | Invention Example |
| 6 | 1.90 | 0.82 | 20 | Invention Example |
| 7 | 1.91 | 0.82 | 20 | Invention Example |
| 8 | 1.90 | 0.83 | 20 | Invention Example |
| 9 | 1.92 | 0.82 | 20 | Invention Example |
| 10 | 1.91 | 0.82 | 20 | Invention Example |
| 11 | 1.90 | 0.82 | 20 | Invention Example |
| 12 | 1.91 | 0.82 | 20 | Invention Example |
| 13 | 1.92 | 0.82 | 20 | Invention Example |
| 14 | 1.92 | 0.82 | 20 | Invention Example |
| 15 | 1.91 | 0.82 | 20 | Invention Example |
| 16 | 1.92 | 0.82 | 20 | Invention Example |
| 17 | 1.92 | 0.82 | 20 | Invention Example |
| 18 | 1.91 | 0.92 | 20 | Comparative Example |
| 19 | 1.92 | 0.82 | 30 | Invention Example |
| 20 | 1.91 | 0.84 | 50 | Comparative Example |
| 21 | 1.90 | 0.82 | 50 | Comparative Example |

for 3 hours in a nitrogen atmosphere is conducted, results of which are also shown in Table 2.

As seen from Table 2, both the magnetic characteristics and coating properties are good when the tension ratio R is a range of 1.20-4.0, and when the heating ratio in the primary recrystallization annealing exceeds 50° C./s, the iron loss $W_{17/50}$ is further better to be not more than 0.84 W/kg.

The invention claimed is:

1. A grain-oriented electrical steel sheet provided on its sheet surface with a tension-imparting type insulation coating constituted with a coating layer A formed on a steel sheet side and mainly composed of an oxide and a coating layer B formed on the coating layer A and mainly composed of glass, characterized in that a ratio R ($\sigma_B/\sigma_A$) of a tension $\sigma_B$ to a tension $\sigma_A$ is within a range of 1.20-4.0, wherein:

the tension $\sigma_A$ is a tensile stress applied to the steel sheet by the coating layer A as a result of a difference between the coefficient of thermal expansion of the steel sheet and the coefficient of thermal expansion of the coating layer A, and the tension $\sigma_B$ is a tensile stress applied to the steel sheet by the coating layer B as a result of a difference between the coefficient of thermal expansion of the steel sheet and the coefficient of thermal expansion of the coating layer B.

2. The grain-oriented electrical steel sheet according to claim 1, wherein the oxide of the coating layer A is forsterite and the glass of the coating layer B is silicophosphate based glass containing one or more metallic elements selected from Mg, Al, Ca, Ti, Nd, Mo, Cr, B, Ta, Cu and Mn.

3. The grain-oriented electrical steel sheet according to claim 1, wherein the tension $\sigma_A$ is not more than 6 MPa.

4. The grain-oriented electrical steel sheet according to claim 1, wherein a coating weight of the coating layer A is 1.0-3.0 g/m$^2$ as converted to oxygen.

5. The grain-oriented electrical steel sheet according to claim 1, which is formed by subjecting a cold rolled sheet rolled to a final thickness to a secondary recrystallization annealing after a primary recrystallization annealing, wherein the primary recrystallization annealing comprises heating within a temperature range of 100° C. to 700° C. at a heating rate of not less than 50° C./s.

6. The grain-oriented electrical steel sheet according to claim 2, wherein the tension $\sigma_A$ is not more than 6 MPa.

7. The grain-oriented electrical steel sheet according to claim 2, wherein a coating weight of the coating layer A is 1.0-3.0 g/m$^2$ as converted to oxygen.

8. The grain-oriented electrical steel sheet according to claim 3, wherein a coating weight of the coating layer A is 1.0-3.0 g/m$^2$ as converted to oxygen.

9. The grain-oriented electrical steel sheet according to claim 6, wherein a coating weight of the coating layer A is 1.0-3.0 g/m$^2$ as converted to oxygen.

10. The grain-oriented electrical steel sheet according to claim 2, which is formed by subjecting a cold rolled sheet rolled to a final thickness to a secondary recrystallization annealing after a primary recrystallization annealing, wherein the primary recrystallization annealing comprises heating within a temperature range of 100° C. to 700° C. at a heating rate of not less than 50° C./s.

11. The grain-oriented electrical steel sheet according to claim 3, which is formed by subjecting a cold rolled sheet rolled to a final thickness to a secondary recrystallization annealing after a primary recrystallization annealing, wherein the primary recrystallization annealing comprises heating within a temperature range of 100° C. to 700° C. at a heating rate of not less than 50° C./s.

12. The grain-oriented electrical steel sheet according to claim 4, which is formed by subjecting a cold rolled sheet rolled to a final thickness to a secondary recrystallization annealing after a primary recrystallization annealing, wherein the primary recrystallization annealing comprises heating within a temperature range of 100° C. to 700° C. at a heating rate of not less than 50° C./s.

13. The grain-oriented electrical steel sheet according to claim 6, which is formed by subjecting a cold rolled sheet rolled to a final thickness to a secondary recrystallization annealing after a primary recrystallization annealing, wherein the primary recrystallization annealing comprises heating within a temperature range of 100° C. to 700° C. at a heating rate of not less than 50° C./s.

14. The grain-oriented electrical steel sheet according to claim 7, which is formed by subjecting a cold rolled sheet rolled to a final thickness to a secondary recrystallization annealing after a primary recrystallization annealing, wherein the primary recrystallization annealing comprises heating within a temperature range of 100° C. to 700° C. at a heating rate of not less than 50° C./s.

15. The grain-oriented electrical steel sheet according to claim 8, which is formed by subjecting a cold rolled sheet rolled to a final thickness to a secondary recrystallization annealing after a primary recrystallization annealing, wherein the primary recrystallization annealing comprises heating within a temperature range of 100° C. to 700° C. at a heating rate of not less than 50° C./s.

16. The grain-oriented electrical steel sheet according to claim 9, which is formed by subjecting a cold rolled sheet rolled to a final thickness to a secondary recrystallization annealing after a primary recrystallization annealing, wherein the primary recrystallization annealing comprises heating within a temperature range of 100° C. to 700° C. at a heating rate of not less than 50° C./s.

17. A grain-oriented electrical steel sheet provided on its sheet surface with a tension-imparting type insulation coating constituted with a coating layer A formed on a steel sheet side and mainly composed of forsterite and a coating layer B formed on the coating layer A and mainly composed of a silicophosphate based glass containing one or more metallic elements selected from Mg, Al, Ca, Ti, Nd, Mo, Cr, B, Ta, Cu and Mn, characterized in that a ratio R ($\sigma_B/\sigma_A$) of a tension $\sigma_B$ applied to the steel sheet by the coating layer B to a tension $\sigma_A$ applied to the steel sheet by the coating layer A is within a range of 1.20-4.0.

18. A grain-oriented electrical steel sheet provided on its sheet surface with a tension-imparting type insulation coating constituted with a coating layer A formed on a steel sheet side and mainly composed of an oxide and a coating layer B formed on the coating layer A and mainly composed of glass, characterized in that a ratio R ($\sigma_B/\sigma_A$) of a tension $\sigma_B$ applied to the steel sheet by the coating layer B to a tension $\sigma_A$ applied to the steel sheet by the coating layer A is within a range of 1.20-4.0, wherein the grain-oriented electrical steel sheet is formed by subjecting a cold rolled sheet rolled to a final thickness to a secondary recrystallization annealing after a primary recrystallization annealing, wherein the primary recrystallization annealing comprises heating within a temperature range of 100° C. to 700° C. at a heating rate of not less than 50° C./s.

* * * * *